US009410228B2

(12) United States Patent
Bae et al.

(10) Patent No.: US 9,410,228 B2
(45) Date of Patent: Aug. 9, 2016

(54) METAL MATRIX COMPOSITE, AND PREPARATION METHOD THEREOF

(75) Inventors: Dong Hyun Bae, Seoul (KR); Hyun Joo Choi, Seoul (KR)

(73) Assignee: Industry-Academic Cooperation Foundation Yonsei University, Seoul (KR)

( * ) Notice: Subject to any disclaimer, the term of this patent is extended or adjusted under 35 U.S.C. 154(b) by 1070 days.

(21) Appl. No.: 13/513,715

(22) PCT Filed: Oct. 22, 2010

(86) PCT No.: PCT/KR2010/007268
§ 371 (c)(1),
(2), (4) Date: Jun. 4, 2012

(87) PCT Pub. No.: WO2011/071240
PCT Pub. Date: Jun. 16, 2011

(65) Prior Publication Data

US 2012/0241670 A1 Sep. 27, 2012

(30) Foreign Application Priority Data

Dec. 9, 2009 (KR) ..... 10-2009-0121630
Aug. 6, 2010 (KR) ..... 10-2010-0075762

(51) Int. Cl.
*B22F 3/15* (2006.01)
*C22C 1/10* (2006.01)
*C22C 32/00* (2006.01)

(52) U.S. Cl.
CPC ..... *C22C 1/1084* (2013.01); *C22C 1/1005* (2013.01); *C22C 32/0052* (2013.01); *C22C 32/0057* (2013.01); *C22C 32/0084* (2013.01); *B22F 2998/10* (2013.01); *B22F 2999/00* (2013.01)

(58) Field of Classification Search
None
See application file for complete search history.

(56) References Cited

U.S. PATENT DOCUMENTS 4,722,751 A 2/1988 Akechi et al.
5,632,827 A 5/1997 Fujita et al.
8,119,095 B2 * 2/2012 Ahn ..... B82Y 30/00 252/502
2005/0186104 A1 * 8/2005 Kear ..... B82Y 30/00 419/11
2006/0153728 A1 * 7/2006 Schoenung ..... B22F 9/04 419/32
2007/0134496 A1 * 6/2007 Katagiri ..... B82Y 30/00 428/408
2008/0310989 A1 12/2008 Tschofen
2009/0162654 A1 * 6/2009 So ..... B82Y 30/00 428/367

FOREIGN PATENT DOCUMENTS

CN 1408891 A 4/2003
CN 1924073 A 3/2007
CN 101142045 A 3/2008
EP 0147769 A2 7/1985
JP H10-168502 A 6/1998

OTHER PUBLICATIONS

Barrera, E.V., et al.; "Development of Fullerene-Reinforced Aluminum"; J. Mater. Res., vol. 10, No. 2; Feb. 1995; pp. 366-371.
Khalid, F.A., et al.; "Study of Microstructure and Interfaces in an Aluminium—C60 Composite Material"; Acta Materialia; vol. 51, Issue 15, Sep. 3, 2003, pp. 4575-4582.
Tokunaga, T., et al.; "Microstructure and mechanical properties of aluminum-fullerene composite fabricated by high pressure torsion"; Scripta Materialia; vol. 58, Issue 9, May 2008, pp. 735-738.
Choi, H.J., et al.; "Reinforcement with carbon nanotubes in aluminum matrix composites"; Scripta Materialia; vol. 59, Issue 3, Aug. 2008, pp. 360-363.
Topcu, I., et al.; "Processing an mechanical properties of B4C reinforced AI matrix composites"; Journal of Alloys and Compounds; vol. 482, Issues 1-2, Aug. 12, 2009, pp. 516-521.

* cited by examiner

*Primary Examiner* — George Wyszomierski
*Assistant Examiner* — Ngoclan T Mai
(74) *Attorney, Agent, or Firm* — Rosenberg, Klein & Lee

(57) ABSTRACT

The present invention provides a preparation method of a metal matrix composite. The method comprises the following steps of: 1) pulverizing a solid carbon material to a micrometer size; 2) plastic deforming a metal matrix powder and dispersing the pulverized nanometer-sized carbon material into the metal matrix powder during the plastic deformation; 3) integrating the metal/carbon nano-material composite powder obtained in step 2) by using a hot forming process; and 4) heat treating the integrated bulk material at a predetermined temperature to form a composite having a metal-carbon nanophase, a metal-carbon nanoband formed by growth of the metal-carbon nanophase, or a metal-carbon nano-network structure formed by self-coupling of the metal-carbon nanoband.

14 Claims, 10 Drawing Sheets

(a) (b)

* Mg-B 550°C annealed, hardness

METAL MATRIX COMPOSITE, AND PREPARATION METHOD THEREOF

TECHNICAL FIELD

The present invention relates to a metal matrix composite and a method of manufacturing the same, and more particularly, to a metal matrix composite, which is configured such that the mechanical properties can be remarkably improved using a carbon nano material and a powder process, and a method of manufacturing the same.

BACKGROUND ART

Studies aimed to improve the mechanical properties, thermal properties, electrical properties, and the like of metal material by dispersing a heterogeneous carbon nano material, such as carbon nanotubes or fullerene (e.g. $C_{60}$), therein have been actively carried out for the last 10 years. In the early stages after the manufacture, most carbon nano materials are present in the form of being coagulated by van der Waals force due to their small size. It is therefore very difficult to disperse such nano materials in a material, such as a metal, which has a very compact crystal structure, by dividing respective particles of the nano material. Therefore, studies on composites using such carbon nano materials are not active.

Taking fullerene as an example, most overseas research achievements reported to date used a powder process (E. V. Barrera, J. Sims, and D. L. Callahan, J. Mater. Res. 1995; 10; 367) or a casting process (F. A. Khalid, O. Beffort, U. E. Klotz, B. A. Keller, P. Gasser, S. Vaucher, Acta Mater. 2003; 51; 4575). Recently, a research achievement using steel plastic deformation (T. Tokunaga, K. Kaneko, K. Sato, Z. Horita, Scripta Mater. 2008; 58; 735) was published. However, the metal/fullerene composite produced through the foregoing research result does not exhibit any merits as nano particles, since the size of the fullerene particles is on the order of tens of micrometers.

Although one fullerene molecule is a very fine particle having a size of about 1 nm, fullerene particles are bonded together such that they form a face-centered cubic (fcc) structure, and are present in the form of powder having a size on the order of tens of micrometers in the early stage. In the above research, since fullerene particles having the shape of the early stage are dispersed in the metal matrix, fullerene is present as particles having a size of tens of micrometers instead of being dispersed as nano particles. In addition, when the powder process is used, fullerene particles having a size on the order of tens of micrometers are present on the surface instead of penetrating into the metal powder. Since such particles obstruct intermolecular bonding when integrated, it is difficult to manufacture a bulk material and commercial applicability is lacking. The use of the casting process makes the manufacturing process easier and simpler than the case of using the powder process, thereby achieving excellent commercial applicability. However, in casting, fullerene rises to the surface of molten metal and does not mix with metal, because the specific gravity of fullerene is lower than that of metal. Therefore, because of the foregoing difficulties in the manufacturing process, there are no precedents to date in which a metal-carbon nano material composite that has realized advantages and excellent characteristics of a nano-size carbon material, such as fullerene or carbon nano tubes, has been developed to the present.

DISCLOSURE

Technical Problem

The present invention has been made to solve the foregoing problems with the related art and an object of the invention is to provide a metal matrix composite and a method of manufacturing the same, in which a carbon material, which is present in the form of powder having a size on the order of micrometers, is pulverized into a nano-size carbon material using a powder process, and is then dispersed into a metal matrix, thereby improving the properties of the material.

Another object of the invention is to provide a metal matrix composite and a method of manufacturing the same, in which a carbon material such as fullerene, which is arranged in a face-centered cubic (fcc) structure in the early stage and is present in the form of powder having a size from several micrometers to tens of micrometers or greater, is divided into the size of nanometers and is then uniformly dispersed in the metal matrix.

A further object of the invention is to provide a metal matrix composite and a method of manufacturing the same, in which grains thereof are not coarsened and maintain a stable structure even when exposed to high temperature for a long time, thereby improving the properties of the composite.

Another object of the invention is to provide a metal matrix composite and a method of manufacturing the same, in which a bulk material having a large size can be mass-produced using a simple mechanical process, and new phases or structures, which may enable excellent material properties, can be provided.

A further object of the invention is to provide a metal matrix composite and a method of manufacturing the same, in which a mechanism that exhibits a different behavior from a precipitation hardening mechanism of the related art provides a new phase or structure, which can improve the material properties, such as strength, of a metal matrix alloy, such as an aluminum (Al) alloy.

Technical Solution

In order to realize the foregoing object, according to the present invention, provided is a method of manufacturing a metal matrix composite. The method includes the following steps of: 1) pulverizing a solid carbon material into a micrometer size; 2) plastically deforming metal matrix powder while dispersing the pulverized carbon material into the metal matrix powder so as to be dispersed in a nanometer size; 3) integrating composite powder, which is composed of the metal matrix powder and the carbon nano material and is produced in the step 2), via hot molding; and 4) forming a composite having therein a metal-carbon nano phase, a metal-carbon nano strip produced by growing-up of the metal-carbon nano phase, or a metal-carbon nano network structure produced by self-assembly of the nano strip by heat-treating a bulk material that is produced by the integration.

According to the invention, carbon atoms may penetrate into the lattice of the metal matrix due to the heat treatment in the step 4), so that the lattice of the metal matrix is deformed or expanded, thereby forming the metal-carbon nano phase, the metal-carbon nano strip, or metal-carbon nano network structure.

In an embodiment, the heat treatment in the step 4) may be performed in a temperature range that is sufficient for individual carbon atoms to diffuse to a short distance and penetrate into the lattice of the metal matrix, but not to form a carbon compound. It is preferred that the heat treatment be performed at a temperature ranging from $0.5T_m$ to $1T_m$ ($T_m$: melting temperature of the metal matrix).

In an embodiment, the metal matrix powder may be a pure metal, such as aluminum, copper, iron, titanium or magnesium, or a plastically-deformable alloy that has at least one selected from among the pure metals as a matrix. The carbon material may be fullerene, carbon nano tube, graphite, carbon black or amorphous carbon.

In an embodiment, the metal matrix powder may be aluminum powder, and the carbon material may be fullerene. In this case, the composite in the step 4) may contain aluminum-carbon nano phase particles, which are expressed by $Al_4C_x$ ($0<x<3$), an aluminum-carbon nano strip produced by growing-up of the aluminum-carbon nano particles, or an aluminum-carbon network structure produced by self-assembly of the nano strip.

In an embodiment, the carbon material may be pulverized using a mechanical milling process in the steps 1) and 2).

According to another aspect of the invention, provided is a metal matrix composite that is manufactured using metal matrix powder and a carbon material. The metal matrix composite contains therein metal-carbon nano phase particles, which are formed as individual carbon atoms released when a carbon-carbon bonding of the carbon material is broken penetrate into a lattice of the metal matrix through short-distance diffusion so that the lattice of the metal matrix is deformed or expanded, a metal-carbon nano strip produced by growing-up of the metal-carbon nano phase particles, or a metal-carbon nano network structure produced by self-assembly of the nano strip. The metal matrix composite does not contain a carbon composite caused by the carbons.

According to the invention, dislocations may be fixed around the metal-carbon nano phase particles, or grains of the metal matrix may be micronized or growing-up thereof may be inhibited due to the metal-carbon nano strip or the metal-carbon nano network structure.

In an embodiment, the metal matrix powder may aluminum powder, and the carbon material may be fullerene. Here, the metal matrix composite may have a mechanical strength exceeding 500 MPa.

According to another aspect of the invention, provided is a method of manufacturing a metal matrix composite. The method includes the steps of: a) pulverizing fullerene, which is arranged in a face-centered cubic (fcc) structure in an early stage and is present in a form of powder having a micrometer size, via mechanical milling; b) plastically deforming metal matrix powder via mechanical milling while dispersing the pulverized fullerene into the metal matrix powder so as to be dispersed in a nanometer size; c) integrating composite powder composed of the metal matrix powder and the fullerene via hot molding; and d) forming a composite having therein a metal-carbon nano phase, a metal-carbon nano strip produced by growing-up of the metal-carbon nano phase, or a metal-carbon nano network structure produced by self-assembly of the nano strip by heat-treating the integrated composite powder.

According to another aspect of the invention, provided is a metal matrix composite that is manufactured using aluminum powder and fullerene. The metal matrix composite contains therein metal-carbon nano phase particles, which are formed as individual carbon atoms released when carbon-carbon bonding of the carbon material is broken penetrate into a lattice of the metal matrix through short-distance diffusion so that the lattice of the metal matrix is deformed or expanded, an aluminum-carbon nano strip produced by growing-up of the aluminum-carbon nano phase particles, or an aluminum-carbon nano network structure produced by self-assembly of the aluminum-carbon nano strip. The metal matrix composite does not contain a carbon compound ($Al_4C_3$) caused by the carbons. Here, the metal matrix composite has a mechanical strength exceeding 500 MPa.

According to a further aspect of the invention, provided is a method of manufacturing a metal matrix composite. The method includes the following steps of: 1) pulverizing a solid compound, which contains an interstitial element of nitrogen or boron, to a micrometer size; 2) producing composite powder by plastically deforming metal matrix powder while dispersing the pulverized solid compound into the metal matrix powder so as to be dispersed in a nanometer size; 3) producing a bulk material by integrating the composite powder; and 4) forming a composite having therein a metal-nitrogen or -boron nano phase, a metal-nitrogen or -boron nano strip produced by growing-up of the metal-nitrogen or -boron nano phase, or a metal-nitrogen or -boron nano network structure produced by self-assembly of the nano strip by heat-treating the bulk material at a predetermined temperature.

In an embodiment, due to the heat treatment in the step 4), nitrogen or boron atoms may penetrate into a lattice of the metal matrix, so that the lattice of the metal matrix is deformed or expanded, thereby forming the metal-nitrogen or -boron nano phase, the metal-nitrogen or -boron nano strip, or the metal-nitrogen or -boron nano network structure.

In an embodiment, in the step 4), the heat treatment may be performed at a temperature ranging from $0.5T_m$ to $1T_m$ ($T_m$: melting temperature of the metal matrix).

In an embodiment, the metal matrix powder may be a pure metal, such as aluminum, copper, iron, titanium or magnesium, or a plastically-deformable alloy that has at least one selected from among the pure metals as a matrix.

In an embodiment, the solid compound may be boron carbide ($B_4C$) or boron nitride (BN). In a specific embodiment, the solid compound may be boron carbide ($B_4C$), and the metal matrix powder may be magnesium (Mg).

According to another aspect of the invention, provided is a metal matrix composite that is manufactured using a solid compound, which contains an interstitial element of nitrogen or boron, and metal matrix powder. The metal matrix composite contains therein metal-nitrogen or -boron nano phase particles, which are formed as nitrogen or boron atoms released when a bonding of the solid compound is broken penetrate into a lattice of the metal matrix through short-distance diffusion so that the lattice of the metal matrix is deformed or expanded, a metal-nitrogen or -boron nano strip produced by growing-up of the metal-nitrogen or -boron nano phase particles, or a metal-nitrogen or -boron nano network structure produced by self-assembly of the nano strips.

In an embodiment, dislocations may be fixed around the metal-nitrogen or -boron nano phase particles, or grains of the metal matrix may be micronized or growing-up thereof may be inhibited due to the metal-nitrogen or -boron nano strip or the metal-nitrogen or -boron nano network structure.

In an embodiment, the metal matrix powder may be a pure metal, such as aluminum, copper, iron, titanium or magnesium, or a plastically-deformable alloy that has at least one selected from among the pure metals as a matrix. The solid compound may be boron carbide ($B_4C$) or boron nitride (BN). In a specific embodiment, the solid compound may be boron carbide ($B_4C$), and the metal matrix powder may be magnesium.

Advantageous Effects

According to the method of manufacturing a metal matrix composite of the invention, a nano carbon material is uniformly added into a metal matrix powder, such that it performs strong interfacial bonding with the surrounding metal atoms. Therefore, due to hot machining performed on the powder, the nano carbon material can be integrated into a fine bulk material. Excellent mechanical properties, such as high strength and ductility, can also be realized, thereby greatly increasing industrial applicability. In addition, according to the invention, when the manufactured bulk composite is heat-treated at a temperature ranging from $0.5T_m$ to $1T_m$ (the melting point of the matrix material), the mechanical properties are not degraded, rather, the mechanical properties are increased due to a metal-carbon nano phase being precipitated in the shape of particles or grown as nano strips, or the particles or strips being bonded together by themselves. Furthermore, the manufacturing method of the invention is very simple and can be easily automated, thereby resulting in low process costs and excellent industrial applicability.

BEST MODE

Reference will now be made in detail to various embodiments of the present invention, examples of which are illustrated in the accompanying drawings and described below. In the following description of the present invention, detailed descriptions of known functions and components incorporated herein will be omitted. However, a person having ordinary skill in the art will be able to clearly comprehend the characteristic features and effects of the invention in light of the following embodiments and realize the present invention with no special difficulties.

1. Pulverization of Carbon Material by Milling

The inventors researched a method of uniformly dispersing a carbon material in a metal matrix. For this, among a variety of solid carbon materials, fullerene, specifically, $C_{60}$ was selected as a carbon material, and aluminum (Al) was selected as a metal matrix. Then, composite powder was manufactured according to the following process.

In the present invention, as described later, it is preferred that the metal matrix material generally be a material that is elastically and plastically deformable such that the carbon nano material, such as fullerene, can be efficiently added and dispersed. For example, it is especially preferred that the material be a pure metal, such as aluminum (Al), copper (Cu), iron (Fe), titanium (Ti) or the like, or a plastically-deformable alloy that has at least one of the pure metals as the matrix.

Figure 1:
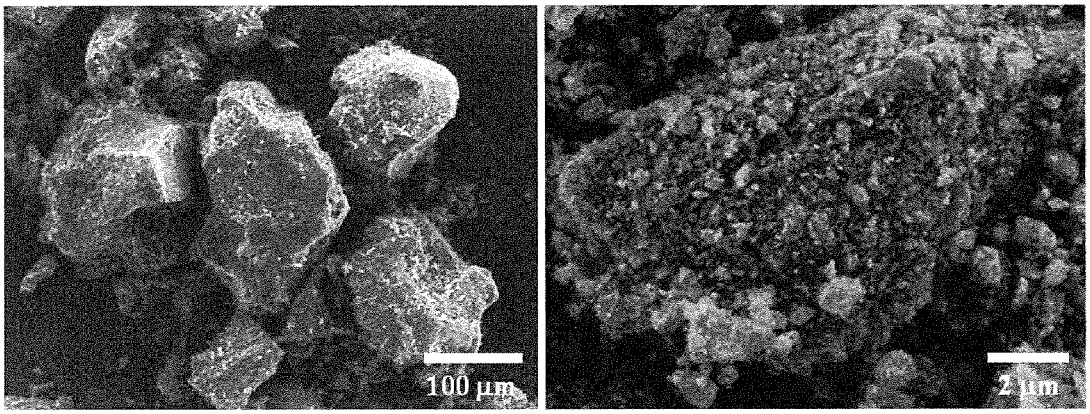
FIG. 1 is pictures showing fullerene particles, in which (a) shows fullerene particles in the early stage, (b) shows fullerene particles which are pulverized according to the invention.

First, as shown in FIG. 1 (*a*), $C_{60}$, a type of fullerene, is arranged in the face-centered cubic (fcc) structure in the early stage and is thus present in the form of powder having several micrometers to tens of micrometers or greater. First, the inventors pulverized $C_{60}$ having the above-described micrometer size using a planetary mill. 2 g $C_{60}$ powder and stainless balls having a diameter of 5 mm (about 800 g) were loaded into a stainless vessel, which was then rotated at a rate of 200 rpm, thereby applying physical energy, i.e. dynamic energy, to the $C_{60}$ powder. In order to prevent excessive heat from being created, the process of air cooling for 30 minutes after milling for 15 minutes was repeated a total of 8 times, thereby performing milling for 2 hours. A picture taken from the pulverized $C_{60}$ particles after the milling using a scanning electron microscope (SEM) is shown in FIG. 1 (*b*). Due to the milling, the $C_{60}$ particles were pulverized to a size ranging from 100 nm to 1 μm. The pulverized particles were weakly coagulated by van der Waals force.

In addition, the above-described mechanical milling is not limited to the planetary mill, but can be performed using a variety of milling methods, such as a spex mill and an attrition mill, which can apply energy to a milling medium such as balls.

2. Preparation of New Al—$C_{60}$ Composite Powder

An attrition mill was used in order to disperse $C_{60}$ particles (2 vol. %) in Al powder (average grain size of 150 μm). That is, after 100 g composite powder of Al and pulverized $C_{60}$ and stainless balls having a diameter of 5 mm (about 1.5 kg) were loaded into a stainless vessel, and then blades were rotated at a rate of 500 rpm, thereby applying energy, with which the materials inside the vessel can collide against each other. While the materials are colliding inside the vessel, cooling water is flown on the outer portion of the vessel, thereby preventing temperature from rising. The atmosphere inside the vessel was maintained using argon (Ar) gas, thereby preventing the Al powder from being oxidized. After the process, the composite powder was collected by separating the powder from the balls using a sieve. The collected powder was photographed using a high-resolution transmission electron microscope (HREM), and the picture is shown in FIG. 2.

Figure 2:
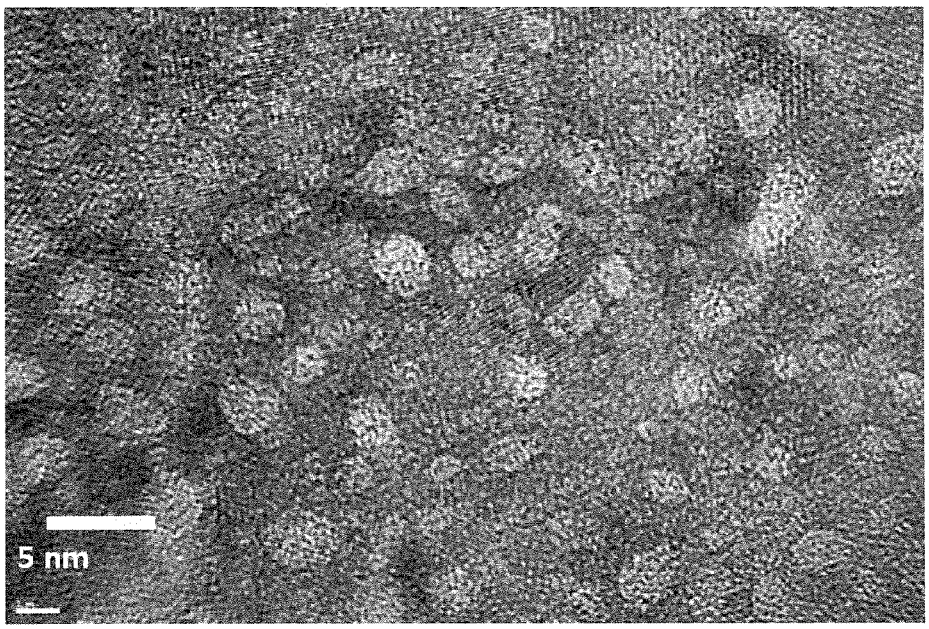
FIG. 2 is a picture of $C_{60}$ fullerene, which is uniformly dispersed in an Al matrix.

As shown in FIG. 2, it can be appreciated that the $C_{60}$ particles are individually separated and are uniformly dispersed. Here, $C_{60}$ is considerably deformed due to the milling, and thus it may be considered that there is possibility that C—C bonding be broken by subsequent heat treatment.

In addition, during the milling, the $C_{60}$ particles penetrate into the Al powder, which is relatively soft. While the Al powder is repeatedly subjected to plastic deformation, crushing, and cold welding, the $C_{60}$ particles may be pulverized into a smaller size, i.e. a nano size, and be uniformly dispersed in the Al powder. It appears that most $C_{60}$ particles penetrated into Al powder, and it is determined that $C_{60}$ will not interfere with intermetallic bonding in a hot molding process.

According to the invention, the $C_{60}$ particles may be pulverized into particles having a size of 1 μm or smaller via the first milling. In the second milling, as the metal powder is plastically deformed, and the $C_{60}$ particles having a nanometer size are uniformly dispersed into the metal powder. As such, according to the invention, the $C_{60}$ particles are uniformly dispersed inside the metal powder due to the first and second milling, and prevent metal atoms from diffusing, thereby stabilizing the microstructure. In addition, due to the absence of $C_{60}$ on the surface of the powder, metal atoms actively diffuse on the surface of the powder, so that bonding between the powder particles is not hindered in the subsequent hot machining, thereby making it possible to produce a high-quality bulk material. That is, the metal-$C_{60}$ composite powder produces a metal matrix composite powder in which the $C_{60}$ nano particles are uniformly dispersed in the metal matrix and forms strong interfacial bonding. Using this composite powder, a high-quality bulk material can be manufactured depending on the subsequent process.

As described above, according to an embodiment of the invention, it is possible to pulverize the $C_{60}$ particles to a size of 1 μm or less or to a smaller nano size by applying impact energy to the composite powder inside the vessel via a medium, such as balls, in a single milling process, such as boll milling or hand milling, under a predetermined condition, which is empirically determined, so that the $C_{60}$ nano particles are inserted into and dispersed in the metal powder. Due to this process prior to the formation of the final bulk material, $C_{60}$ and the metal powder exhibit strong interfacial bonding characteristics due to mechanical interlocking between carbon and metal atoms. Since $C_{60}$ is uniformly dispersed inside the powder, the bonding between the powder particles is not reduced when forming the final bulk material. The above-described step can be carried out through a simplified single process comparing to methods of the related art in which carbon nano tubes are dispersed in the metal matrix through several steps, such as dispersion using a dispersion solution and calcinations.

In embodiments of the invention, the mechanical energy used in the ball milling or hand milling may vary depending on the type and microscopic structure of the metal matrix, and can be controlled depending on the type, size and weight of the milling medium, the speed of the milling, the size of the milling vessel, and the like. In addition to the ball milling, it is possible to disperse the $C_{60}$ in the metal powder by applying a variety of methods, such as simple mixing, ultrasonic processing and hand milling.

3. Manufacturing of Metal Matrix Composite Having New Metal Matrix-C Nano Phase (1) Manufacture of Compact The inventors noticed that it is possible to uniformly disperse $C_{60}$ in the metal matrix through the above-described process, and studied a method with which a final composite can be manufactured in a more simplified process using the above-described composite powder, which is prepared through that process.

That is, in order to prevent the problem in which powder is damaged when metal matrix composite powder in which $C_{60}$ is dispersed is directly machined at a high temperature and high pressure when manufacturing a metal matrix composite, the inventors anticipated that it is possible to prevent the properties of the metal matrix composition powder from degrading during hot processing by preparing an intermediate material (a compact) by first applying only pressure, or by applying pressure in a temperature range in which powder is not damaged, i.e. in which oxidation does not occur, to powder, and then producing a final bulk material by hot-machining the intermediated material, and completed the invention by regarding this technical object as the essential point.

Specifically, the inventors used room-temperature compression as a method of manufacturing an intermediate material by applying pressure to Al—$C_{60}$ (2 vol. %) composite powder, which is manufactured in the above-described milling. The intermediate material was manufactured by loading the composite powder into a copper tube, followed by the application of a pressure of 500 Mpa. In this case, the compressed powder showed porosity of 20% or less, and in the subsequent hot machining, it was possible to prevent the powder from being oxidized or $O_{60}$ from being damaged.

In the meantime, the inventors performed hot rolling at 480° C. in order to perform hot machining on the intermediate material, which was manufactured following the above-described process. Rolling was performed 27 times at a reduction ratio of 12%, and the final thickness of the plate was reduced to 97% of the initial thickness of the intermediate material. In addition to the hot rolling, this hot molding may use a variety of hot molding processes, such as hot extrusion and hot pressing, in which the powder can be integrated due to heat and pressure applied thereto.

Figure 3:
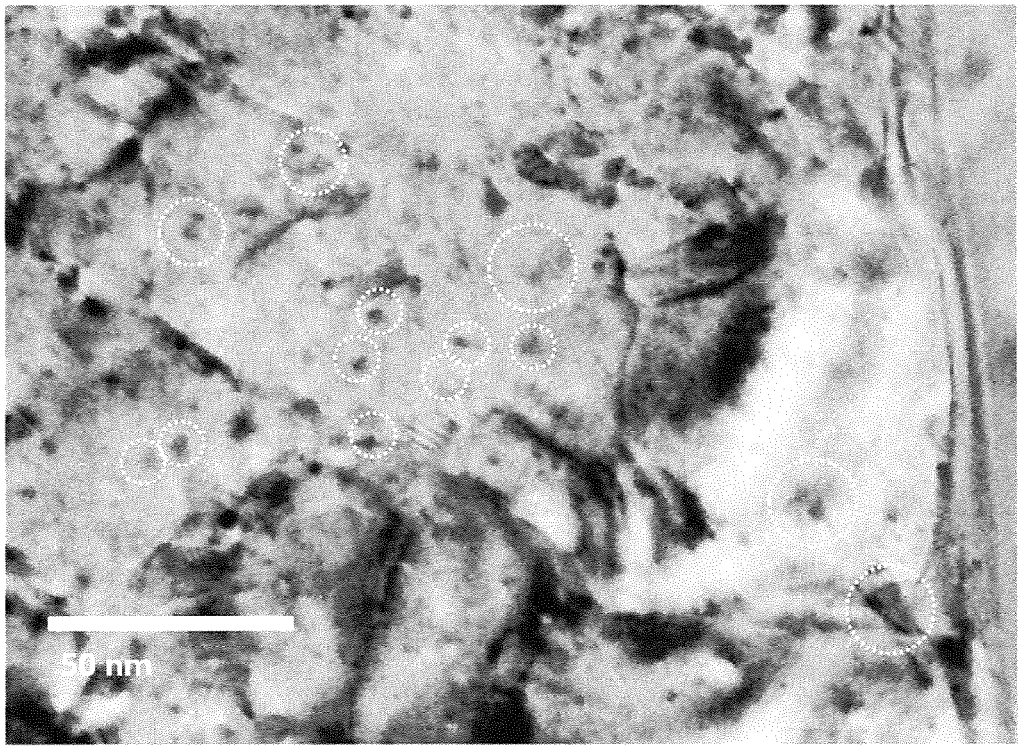
FIG. 3 is a picture of the microstructure of an Al/$C_{60}$ composite after heat-treated for 12 hours, showing that the composite includes a new Al—C nano phase (indicated with dotted lines)

(2) Manufacture of Metal Matrix Composite Having New Metal Matrix-C Nano Phase Due to Heat Treatment The inventors performed heat treatment on the Al/$C_{60}$ composite, which was manufactured according to the above-described process, at 500° C. (0.8Tm, Tm: melting temperature of Al). As can be more clearly understood from the following description, the heat treatment in the invention is performed in a temperature range in which individual C atoms can sufficiently diffuse to a short distance but do not form a carbon compound (carbide). This temperature range is preferably from $0.5T_m$ to $1T_m$ ($T_m$: melting temperature of metal matrix). When the temperature is lower than $0.5T_m$, a sufficient amount of driving force for the C atoms to diffuse to a short distance may not be provided. When the temperature is higher than $1T_m$, a carbon compound may be formed. Therefore, it is preferred that the heat treatment be performed in that temperature range. Thus, it should be understood that the temperature of 500° C. at which the $Al/C_{60}$ composite was heat-treated is merely an example of heat treatment temperature, and the heat treatment of the invention is not limited to that temperature. In the meantime, the heat treatment was performed by loading the $Al/C_{60}$ composite into the furnace, which is maintained at 500° C. in the air, and maintaining this state for a predetermined time, followed by air cooling. Like the above-described heat treatment temperature, it should be understood that the invention is not limited to this heat treatment method. The microstructure due to that heat treatment was shown in FIG. 3. FIG. 3 shows the microstructure taken from the $Al/C_{60}$ composite, which was heat-treated at 500° C. according to the above-described process, using the HREM. The inventors observed that an unexpected microstructure was obtained due to this heat treatment.

Specifically, as apparent from the picture of the microstructure of FIG. 3, in the $Al/C_{60}$ composite of the invention, $C_{60}$ did not maintain the original structure, i.e. the C—C bonding was broken and individual C atoms performed short-distance diffusion. However, because the heat treatment temperature was not sufficiently high and the size of $C_{60}$ was very small, the C atoms did not diffuse as sufficiently as forming a carbon compound $Al_4C_3$, but the C atoms penetrated into the lattice of Al, thereby forming an Al—C nano phase. New phases, which were produced due to that heat treatment, are marked with circles in FIG. 3. As shown in the figure, it can be appreciated that the Al—C nano phases are uniformly formed in the grain. It also appears that dislocations are fixed around the Al—C nano phases, improving the properties of the material, such as high strength, as will be described below.

Figure 4:
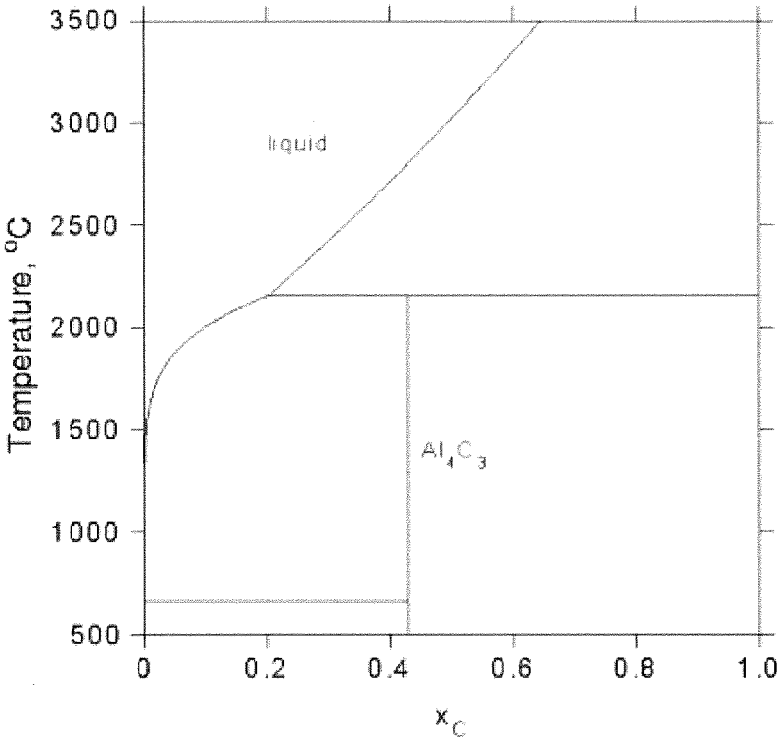
FIG. 4 is a state diagram of Al—C.

Specifically, FIG. 4 shows the state diagram of Al—C. As apparent from the state diagram, when a small amount of C is added to Al, no phases are formed. When C is included in a predetermined range, a carbon compound such as $Al_4C_3$ is formed. It is known, however, that the $Al_4C_3$ carbon compound gradually grows at high temperature, thereby greatly degrading the mechanical properties of an Al—C alloy.

Figure 5:
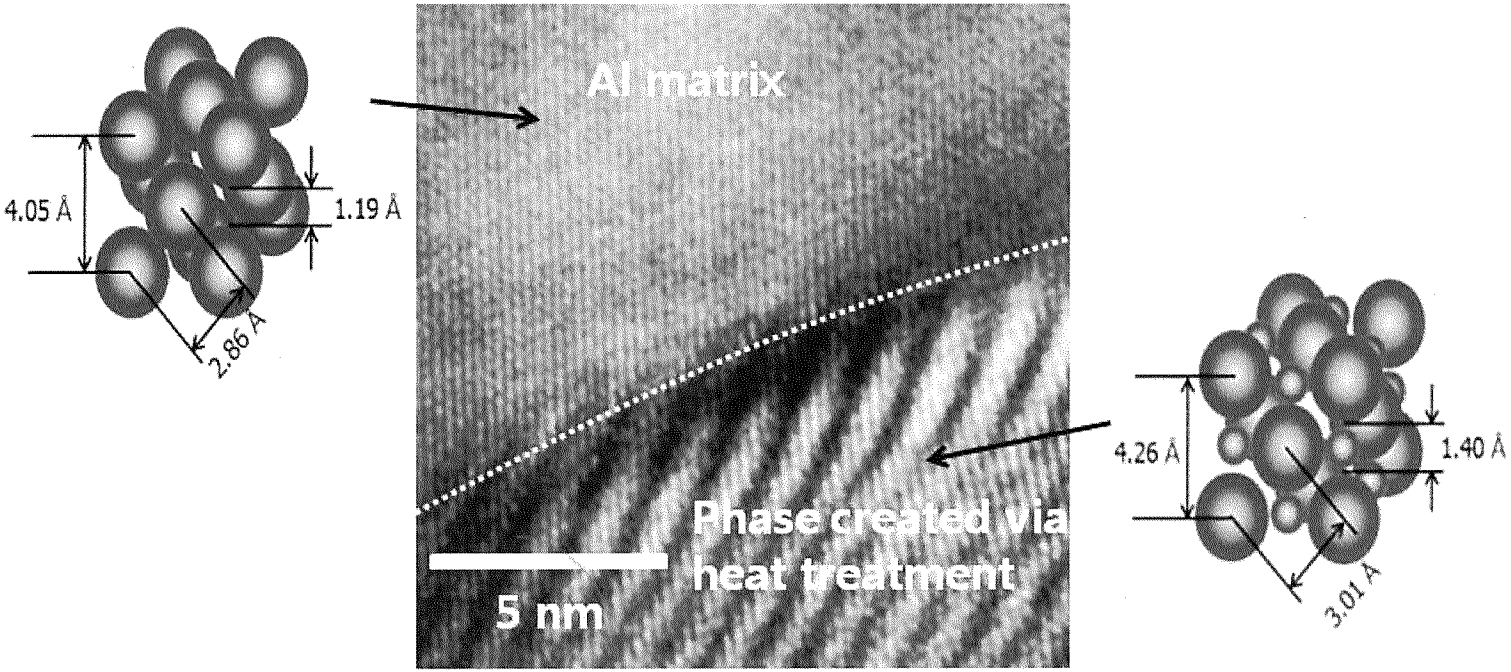
FIG. 5 is a picture of an Al—C nano phase, which is created after an Al/$C_{60}$ composite is heat-treated for 12 hours.

In contrast, the Al—C nano phase contained in the composite of the invention can be expressed by a composition, i.e. $Al_4C_x$ ($0<x<3$), which is different from stoichiometric coefficients of the related art. This phase is a new nano phase that has not been reported in Al—C alloys of the related art. Referring to FIG. 5 taken by magnifying an Al—C nano phase, which is created subsequent to 12 hours heat treatment on an $Al/C_{60}$ composite, it can be appreciated that the lattice constant of the newly-created Al—C nano phase is about 3 Å, which is a great increase from the lattice constant of the Al matrix of about 2.8 Å. This appears because, as shown in FIG. 5, although individual C atoms separated from $C_{60}$ attempted to diffuse into Al in order to form $Al_4C_3$ (carbon compound, aluminum carbide), C was not collected in an amount sufficient to form a carbon compound but occupied the interstitial sites of Al, thereby forming a new phase while causing the Al lattice to deform or expand. As such, the creation of a new phase, i.e. $Al_4C_x$ ($0<x<3$) due to the penetration of C into the interstitial sites of Al leads to a new nano phase that has not been observed in the Al—C state diagram of the related art shown in FIG. 4. This nano phase acts as a factor that significantly increases the properties of the metal matrix composite of the invention, as will be described later.

Figure 6:
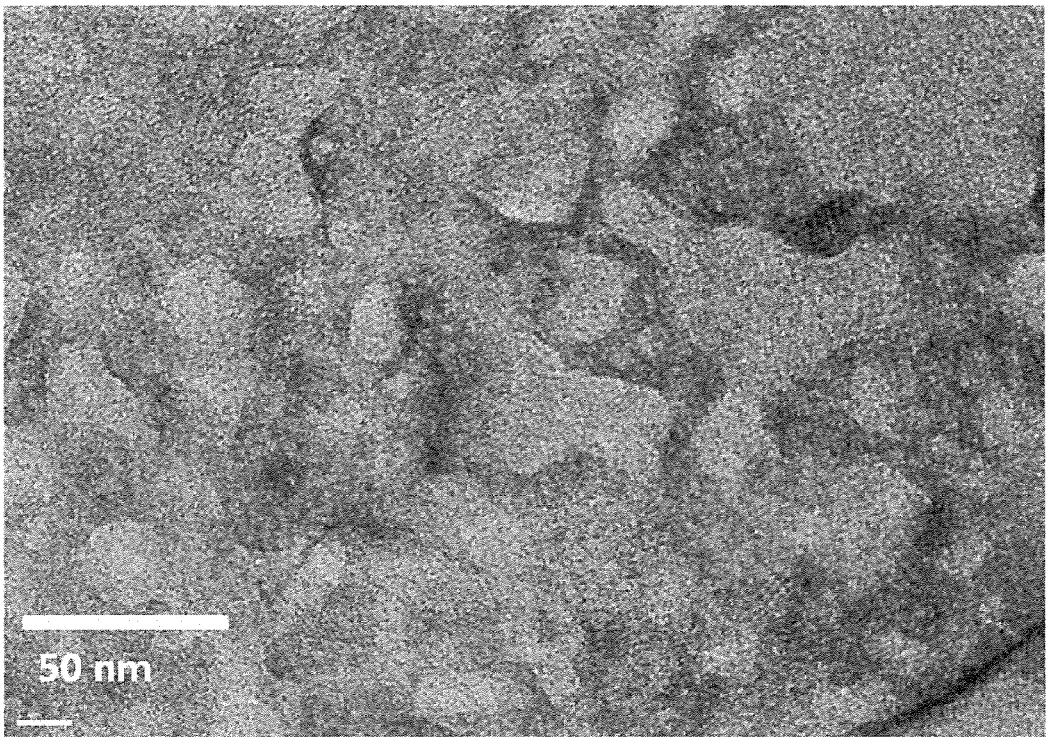
FIG. 6 is a picture of the microstructure of an Al/$C_{60}$ composite after heat-treated for 24 hours, showing that the Al—C nano phase contains a network-type Al—C nano strip structure due to self-assembly.
Figure 7:
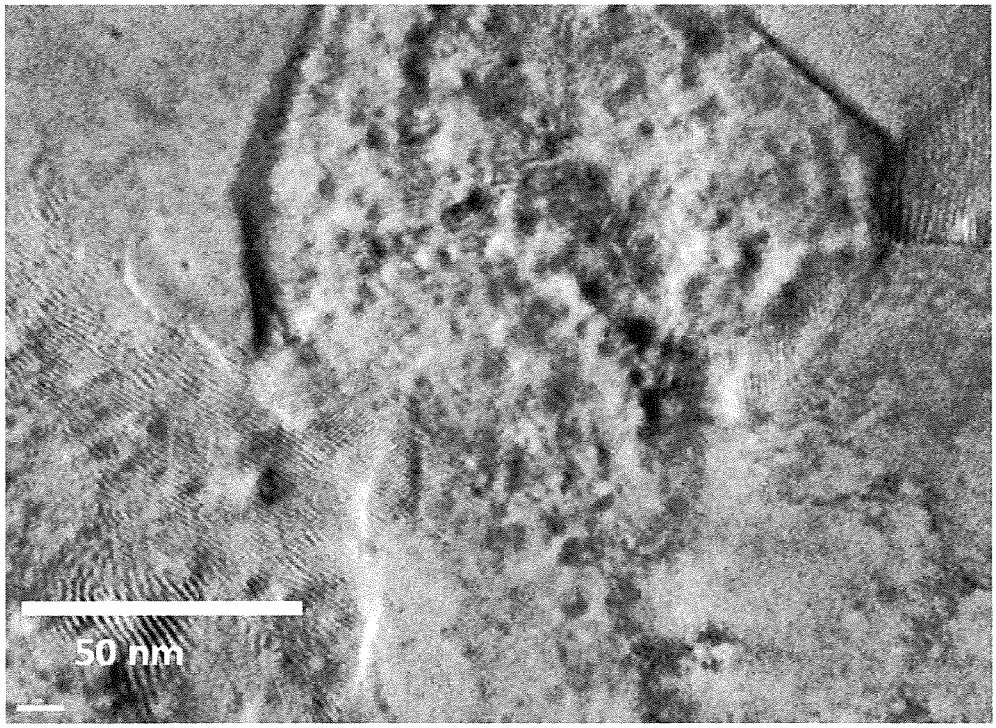
FIG. 7 is a picture of an Al/$C_{60}$ composite after heat-treated for 24 hours, taken by magnifying a network-type Al—C nano strip structure.

After the $Al/C_{60}$ composite manufactured by the above-described process was heat-treated at 500° C. for 24 hours, the inventors examined the microstructure. In FIG. 6, a picture of the microstructure of the $Al/C_{60}$ taken after heat-treated for 24 hours is shown. Comparing with the case of FIG. 5, which involved heat treatment for 12 hours, the Al—C nano phase shown in FIG. 5 anisotropically grew in the form of nano strips or these nano strips are self-assembled in order to minimize lattice deformation energy, thereby forming Al—C nano network structure having a thickness of about 5 to 10 nm around the grains. Due to this, the composite exhibited a very stable structure at high temperature. The picture taken by magnifying this nano network structure is shown in FIG. 7. It can be appreciated that this structure has the same lattice constant as the nano phase that occurred after heat-treated for 12 hours, and has the same structure in which C occupies some sites in the Al lattice. In the meantime, the Al grains acting as the matrix is micronized due to the nano strips. The Al matrix composite having this nano strip structure has further improvement in mechanical strength comparing with the case of FIG. 5.@

In brief, in the metal matrix composite of the invention, the carbon nano material, for example, fullerene $C_{60}$ is pulverized to a nano size and is then uniformly dispersed inside the metal powder, such that it does not hinder the bonding between powder particles when the composite powder composed of the metal matrix and the carbon nano material is integrated later. Furthermore, in the integrated composite, the properties of the material, such as mechanical strength, are greatly improved. Moreover, when the integrated composite is subjected to heat treatment at a temperature lower than the melting point of the metal matrix, the bonding of C atoms of the carbon nano material is broken, so that individual C atoms perform short-distance diffusion, thereby forming metal matrix-C nano phases, metal matrix-C nano strips due to anisotropic growth of the metal matrix-C nano phases, and a metal matrix-C nano network structure due to self-assembly of the nano strips depending on the heat treatment time. These textures are new phases or structures, which have not been reported to date, and which inhibit the growth of the metal matrix grains, thereby realizing a surprising result in which mechanical properties such as strength are improved even though heat treatment is performed for a long time. This improvement in the mechanical properties will be described in more detail as follows.

4. Evaluation of Mechanical Properties of Metal Matrix Composite Having New Metal Matrix-C Nano Structure The inventors tested the mechanical properties of the Al matrix composite, which was manufactured as above, and the results are presented in FIG. 8 to FIG. 10.

Figure 8:
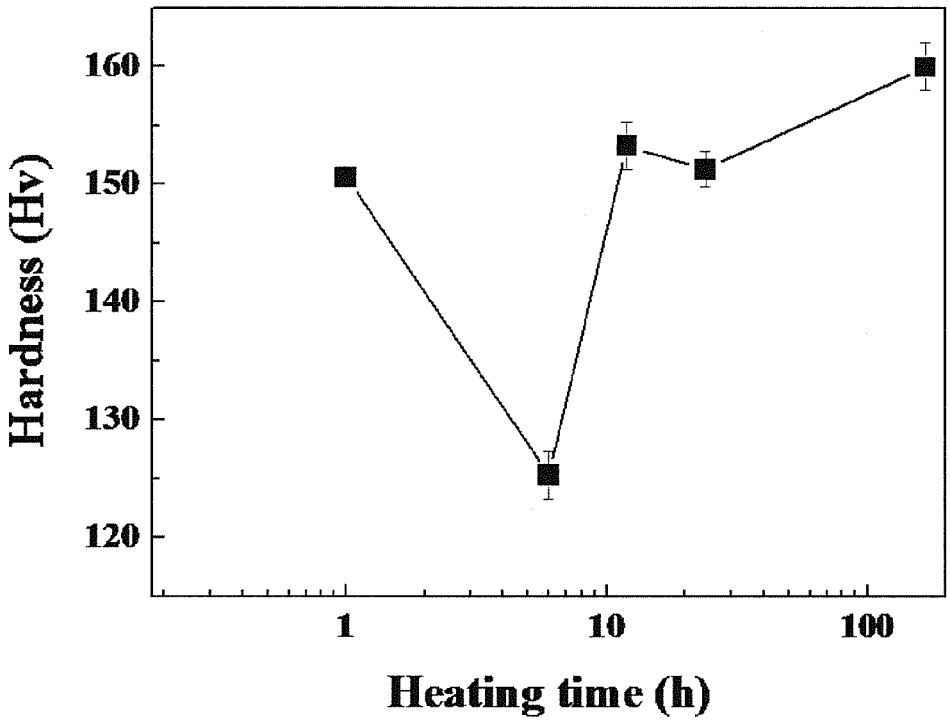
FIG. 8 is a graph showing the hardness of an Al matrix composite of the invention, which changes with time when the composite is heat-treated at 500° C.

FIG. 8 is a graph of the hardness of a composite which was manufactured according to the above-described process, the hardness being presented depending on the time for which the composite was maintained at a temperature of 500° C. It can be appreciated that the hardness dropped due to a recovery phenomenon, such as growth of grains and relaxation of residual stress, up to initial 6 hours. However, as the heat treatment was performed for 12 hours or longer, it can be observed that the hardness of the composite is improved with the increase in the heat treatment time. In order to more correctly measure the strength, the heat treatment was performed on the composite for 1 hour, 24 hours, and 7 days, respectively, and then compression test was performed at a strain of $10^{-4}s^{-1}$. The results are presented in FIG. 9.

The heat treatment for 1 hour refers to annealing intended to remove residual stress, which occurs in the rolling process for manufacturing the composite. Due to the annealing performed for 1 hour like this, the unique mechanical properties of the material can be evaluated.

Figure 9:
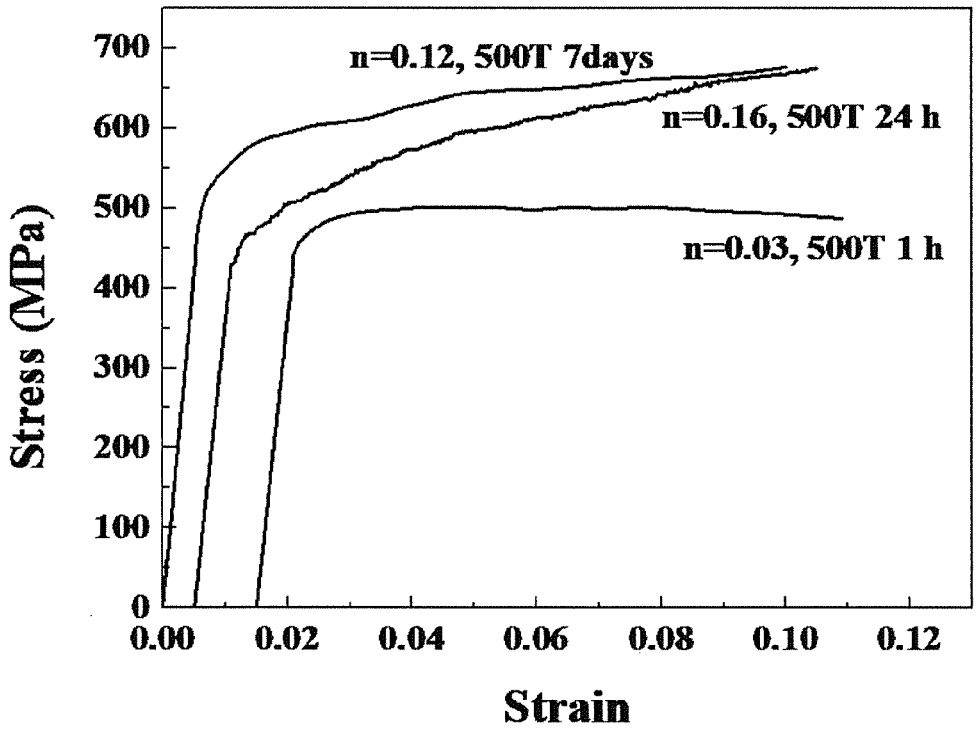
FIG. 9 is a more detailed graph showing the hardness of an Al matrix composite of the invention, which changes with time when the composite is heat-treated at 500° C.

As shown in FIG. 9, it can be appreciated that all of the Al matrix composites exhibited high strength of 500 MPa or greater. In particular, when only the annealing for 1 hour was performed, the mechanical strength of about 500 MPa was observed. It appears that fullerene in the metal matrix maintained the carbon bonding state during the annealing for 1 hour. Fullerene was uniformly inserted into the metal matrix, thereby improving the mechanical strength. This can be regarded as a very surprising result, since this strength was obtained due to the addition of annealing by only 2 vol %.

It can also be appreciated that the strength is much above 500 MPa due to the increase in the heat treatment time on the composite. Comparing to the maximum strength of all of existing Al alloys that is about 500 MPa, the mechanical strength of the composite of the invention can be significantly increased. In particular, the fact that the mechanical strength was significantly increased using only a small amount of fullerene of 2 vol % (1 wt %) is a surprising result. It can also be appreciated that the work hardening exponent n, i.e. a value representing an increase (inclination) in strength in response to variation in strain after metal starts to be plastically deformed, increases in response to an increase in heat treatment time. For reference, when the work hardening exponent is higher, even though the yield strength is the same, the material exhibits more excellent properties after plastic deformation and is evaluated as having fine ductility since the occurrence of necking is generally delayed.

It can be appreciated that the results represented in FIG. 8 and FIG. 9 show different aspects from those of existing precipitation hardening. According to the existing precipitation hardening theory, grains are coarsened with increasing heat treatment time, thereby degrading mechanical strength. That is, there is a certain limit in the ability to increase strength using precipitation hardening. However, according to the invention, as shown in FIG. 8 and FIG. 8, unlike the existing precipitation hardening theory, the mechanical strength increases with the increasing heat treatment time. This appears because, as the heat treatment time increases, metal-C nano phases form metal-C nano strips through anisotropic growth or the metal-C nano strips form a metal-C nano network structure through self-assembly as described above, such that the growth of the grains of the matrix metal is reduced, thereby continuously increasing the strength. This test result is a new phenomenon that did not occur in the existing materials. This will be described in more detail with reference to FIG. 10.

Figure 10:
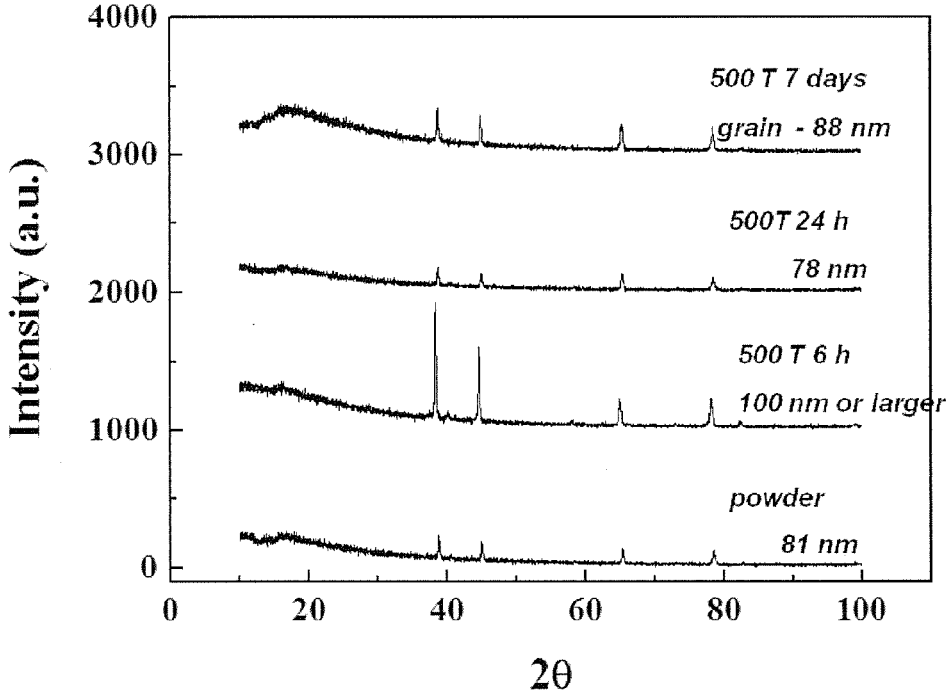
FIG. 10 is a result of X-ray diffraction analysis depending on heat treatment time when an Al matrix composite of the invention is heat-treated at 500° C., showing variation in the size of grains.

FIG. 10 is a view showing the result obtained by measuring variation in the size of grains depending on the heat treatment time through X-ray diffraction analysis. As shown in the figure, it can be appreciated that the grains grew to 100 nm or greater when heat treatment was performed for 6 hours, whereas the size of grains decreased to the order of 80 nm when heat treatment was performed for 24 hours and showed no significant change until the heat treatment continued 7 days. The phenomenon in which the strength gradually increases after the heat treatment was performed for a long time at a high temperature (773K) equal to or higher than $0.8T_m$ (the melting point of Al, 933K) is a unique feature that can be realized by the invention. This can be regarded as excellent property of the composite of the invention that can compensate for the drawback of Al, which is vulnerable to heat.

As such, the composite of the invention exhibits excellent mechanical properties, such as high strength, due to the fullerene nano particles being uniformly dispersed, and the strength thereof is not lowered even after heat-treated at a high temperature. Rather, the strength is further increased by the Al—C nano phases, which were not observed in the related art, the Al—C nano strips formed due to anisotropic growth of the Al—C nano phases, or the Al—C nano network structure due to the self-assembly of the nano strips. Furthermore, very stable high-temperature properties can be exhibited.

The method of manufacturing a composite according to the invention is a simple method that can be applied to the general industry, and enables excellent productivity. In addition, as described above, the final machining material can exhibit excellent mechanical properties since the density thereof is high and the properties of the powder are maintained as they are.

5. Heat Treatment Temperature

Figure 11:
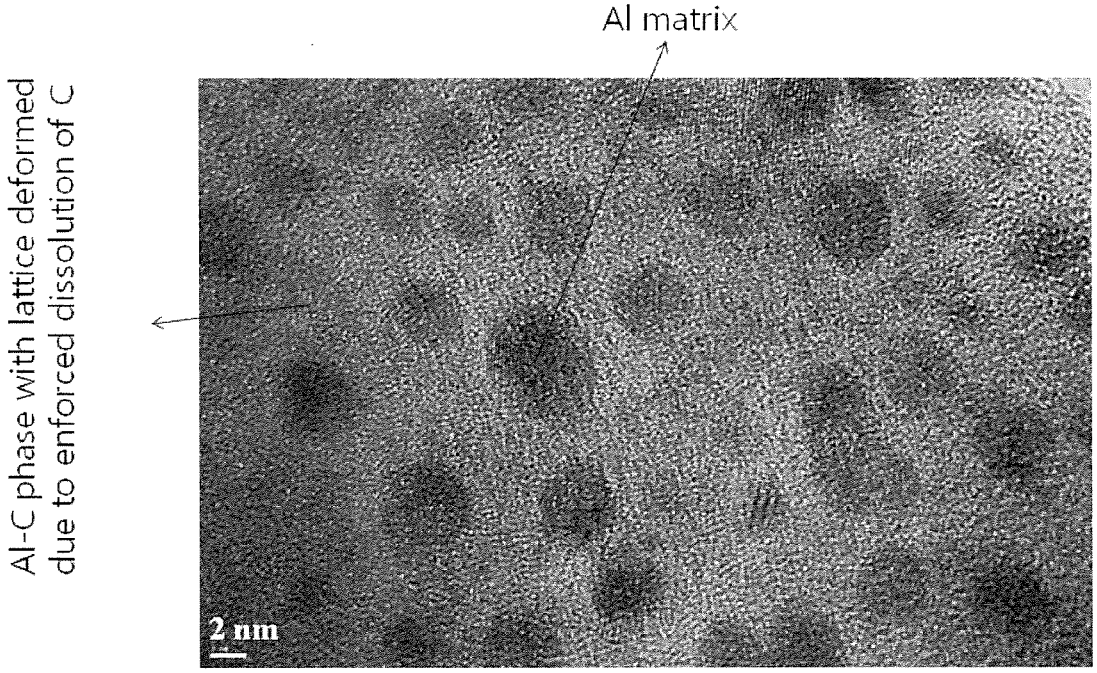
FIG. 11 is a picture of the microstructure of an Al matrix composite taken using a transmission electron microscope (TEM), after heat-treated at 520° C. for 2 hours.

As described above, according to the method and the composite of the invention, the fraction of the Al—C nano phases in which the lattice is deformed due to enforced dissolution of carbon increases as the heat treatment time increases. As for this, the effect of the heat treatment time on the rate of creation of nano phases was tested, and it was observed that the rate of creation of nano phases increased with the increasing heat treatment time. According to an embodiment, as for an Al—$C_{60}$ composite, the rate at which nano phases were created due to heat treatment at 520° C. was compared with the rate at which nano phases were created due to heat treatment at 500° C. FIG. 11 is a picture of the microstructure of an Al—$C_{60}$ composite taken using a transmission electron microscope (TEM), after heat-treated at 520° C. for 2 hours. It can be appreciated that the Al—C nano phases in which the lattice was deformed due to enforced dissolution of carbon were created by heat treatment at 520° C. It was also appreciated that the fraction of the nano phases reached 70% or greater when the heat treatment was performed by only two hours. This indicates that the nano phases can be created at a faster rate when the temperature of the heat treatment is increased according to the invention.

Figure 12:
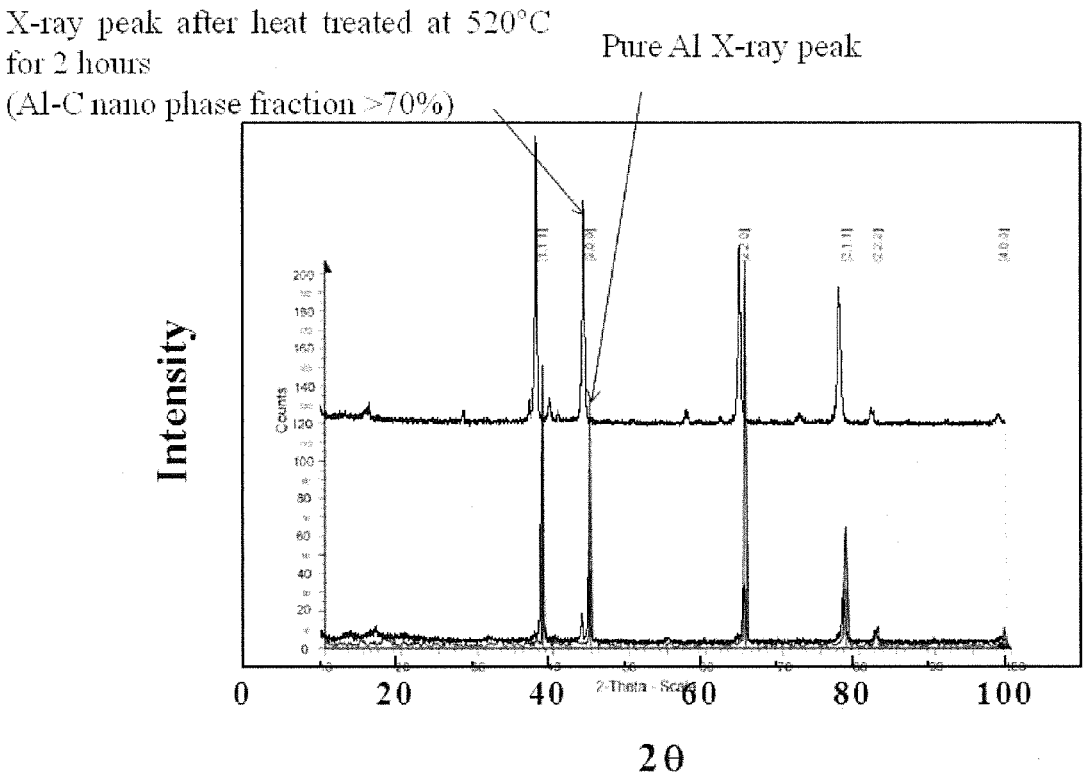
FIG. 12 is a result obtained by measuring variation in the lattice constant of an Al matrix composite according to the invention through X-ray diffraction analysis, after heat-treated at 520° C. for 2 hours, showing that the lattice constant is increased by about 5%.

FIG. 12 is a view showing the result obtained by measuring variation in the lattice constant of a sample through X-ray diffraction analysis, after the heat treatment at 520° C. for 2 hours. From the result of X-ray diffraction analysis shown in the figure, it can be appreciated that the peak is shifted to the left as much as can be observed with the eyes. When respective lattice constants are calculated, it can be appreciated that the lattice constant (about 0.422 nm) of a sample (about 70% or greater of Al—C nano phases), which was heat-treated at 520° C. for 2 hours, is increased about 5% than the lattice constant (about 0.405 nm) of pure aluminum. When the lattice is changed due to an existing atom doping method, the lattice deformation is possible by only about 1%. However, in the composite of the invention, the volume of a unit lattice can be increased by about 15% or greater. It is expected that the composite of the invention is available as materials for energy storage or the like. In addition, the method of manufacturing a composite according to the invention is expected to have high industrial applicability because it is very simple and the manufacturing cost thereof is low.

6. Carbon Material

Although fullerene, in particular, $C_{60}$, was used as a carbon material in the foregoing embodiment, it should be understood that the invention is not limited to $C_{60}$. For example, bucky ball structures of fullerene, such as $C_{17}$ or $C_{120}$, are also applicable to the invention. In addition, it is important to understand that other carbon materials than the fullerene, for example, carbon nanotube, graphite, carbon black, amorphous carbon, and the like, which can be mechanically pulverized to a nanometer size, are also applicable to the invention, and these materials also fall within the scope of the invention.

7. Matrix Metal

Figure 13:
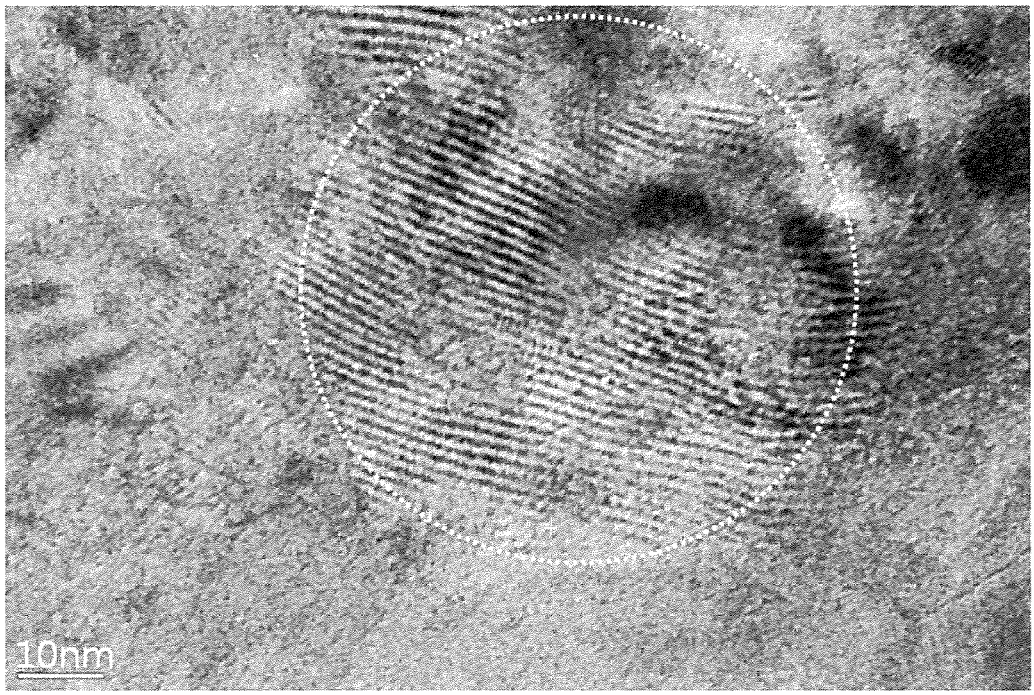
FIG. 13 is a TEM picture showing Mg—C nano phases in which the lattice of Mg is deformed due to enenforced dissolution of C atoms into the lattice when the Mg matrix composite of the invention is heat-treated at 425° C.
Figure 14:
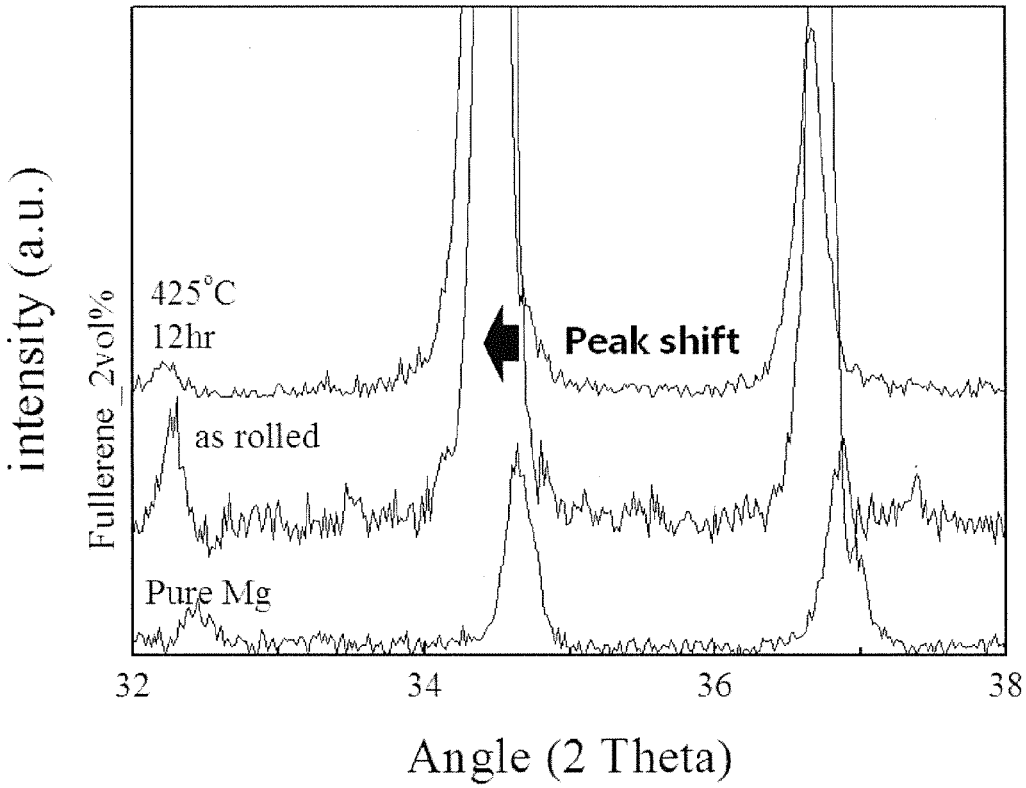
FIG. 14 is a view showing the result obtained by measuring the lattice constant of a sample, which was manufactured by heat-treating a Mg—$C_{60}$ composite at 425° C. for 12 hours, and the lattice constant of a pure Mg sample through X-ray diffraction analysis, showing that the lattice constant was increased than that of the pure Mg sample.
Figure 15:
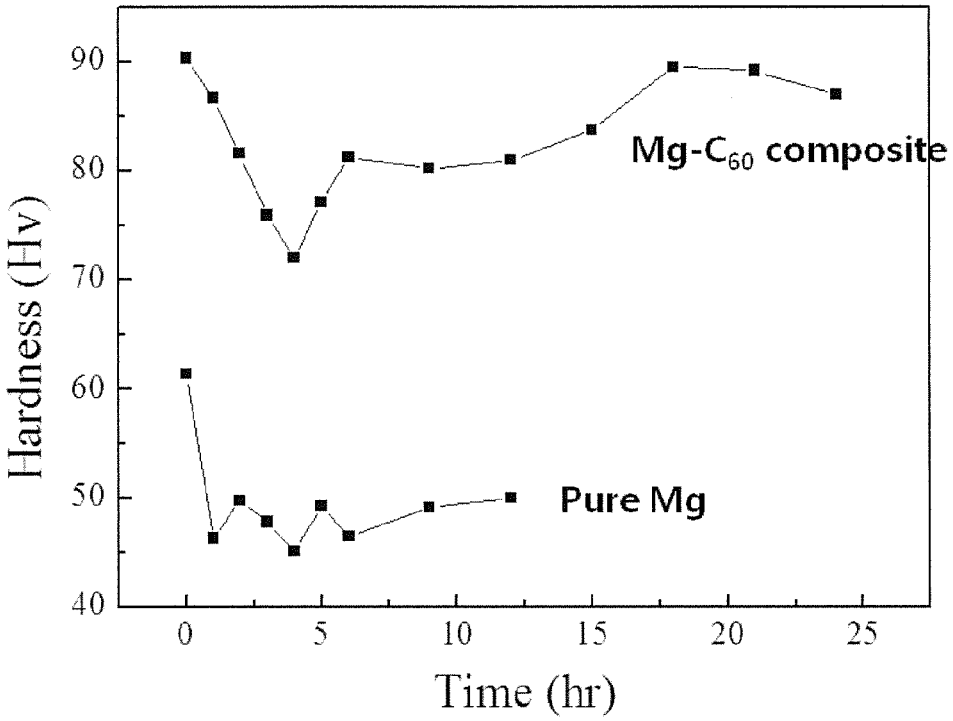
FIG. 15 is a graph obtained by measuring variation in hardness depending on the heat treatment time when a Mg $matix_0$ composite of the invention was heat-treated at 425° C.

Although Al has been described as an example of the matrix metal in the foregoing embodiment, it should be understood that the invention is not limited to Al. That is, it should be understood that a metal matrix composite that has a new metal-C nano phase, a new metal-C nano strip, or a new metal-C nano network structure can be manufactured by applying the method of the invention to any materials, including pure metals, such as copper (Cu), iron (Fe), titanium (Ti), and magnesium (Mg), and plastically-deformable alloys that have at least one selected from among the pure metals, and the like, in addition to Al, as long as they allow efficient penetration and dispersion of a carbon material, such as fullerene. For example, in an embodiment, the inventors carried out an experiment using Mg as a substitute for Al according to the same process as described above. A Mg—$C_{60}$ composite was heat-treated at 425° C. It was observed that lattice-deformed Mg—C nano phases were formed due to enforced dissolution of carbon atoms into the Mg lattice. The result is presented in FIG. 13. In addition, FIG. 14 is a view showing the result obtained by measuring the lattice constant of a sample, which was manufactured by heat-treating a Mg—$C_{60}$ composite at 425° C. for 12 hours, and the lattice constant of a pure Mg sample through X-ray diffraction analysis. It can be appreciated that the X-ray diffraction peak is shifted to the left in the same manner as in the Al—$C_{60}$ composite. This indicates that the lattice constant of Mg is increased. FIG. 15 is a graph obtained by measuring variation in hardness depending on the heat treatment time when a Mg—$C_{60}$ composite sample and a pure Mg sample were heat-treated at 425° C. It can be appreciated that the Mg—$C_{60}$ composite exhibits more excellent hardness than the pure Mg sample. In the pure Mg sample, the hardness is decreased due to annealing in the early stage of the heat treatment and then remains in the decreased value. In contrast, in the Mg—$C_{60}$ composite sample of the invention, after the hardness is decreased due to annealing, the hardness is increased again due to Mg—C nano phases. According to this additional embodiment, it can also be empirically verified that the invention can be put into practice using not only the Al matrix composite but also the Mg matrix composite. In other words, a metal matrix composite that has a new metal-C nano phase, a new metal-C nano strip, or a new metal-C nano network structure can be manufactured by applying the method of the invention to any materials, including pure metals, such as Cu, Fe, Ti, and Mg, and alloys that have at least one selected from among the pure metals, and the like, as long as they allow efficient penetration and dispersion of a carbon material, such as fullerene.

8. Interstitial Element

Figure 16:
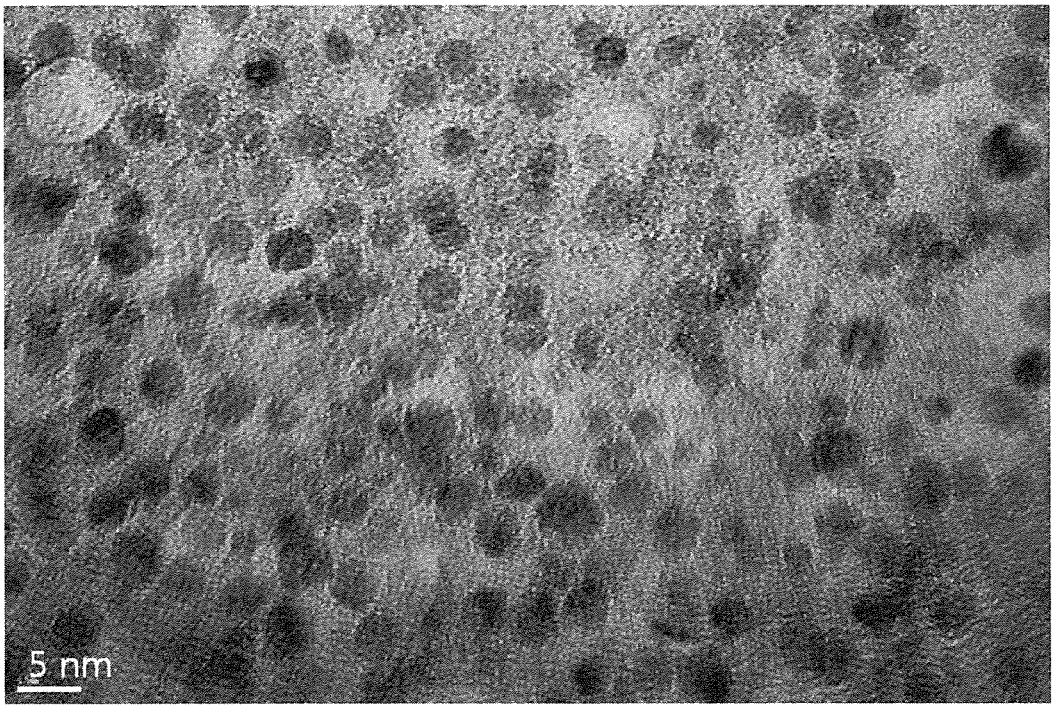
FIG. 16 is a TEM picture of the microstructure of a Mg—$B_4C$ composite of the invention.
Figure 17:
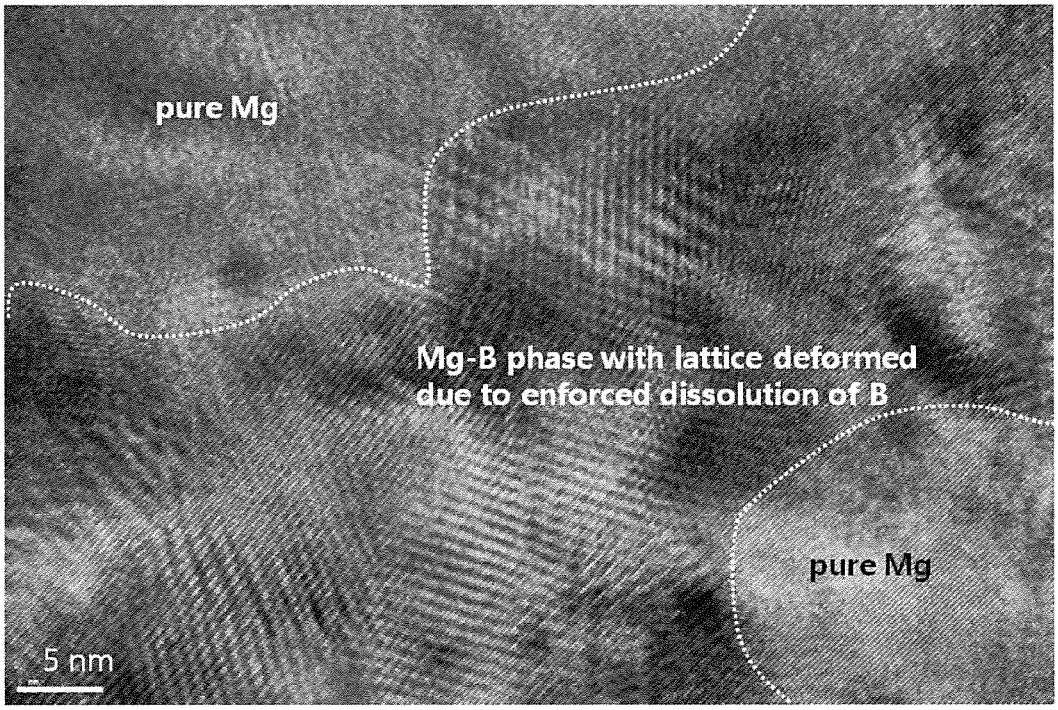
FIG. 17 is a TEM picture of the microstructure of a Mg—$B_4C$ composite of the invention, after heat-treated at 550° C. for 3 hours, showing that the lattice of Mg is deformed due to penetration of B atoms into the lattice, thereby forming Mg—B nano phases.
Figure 18:
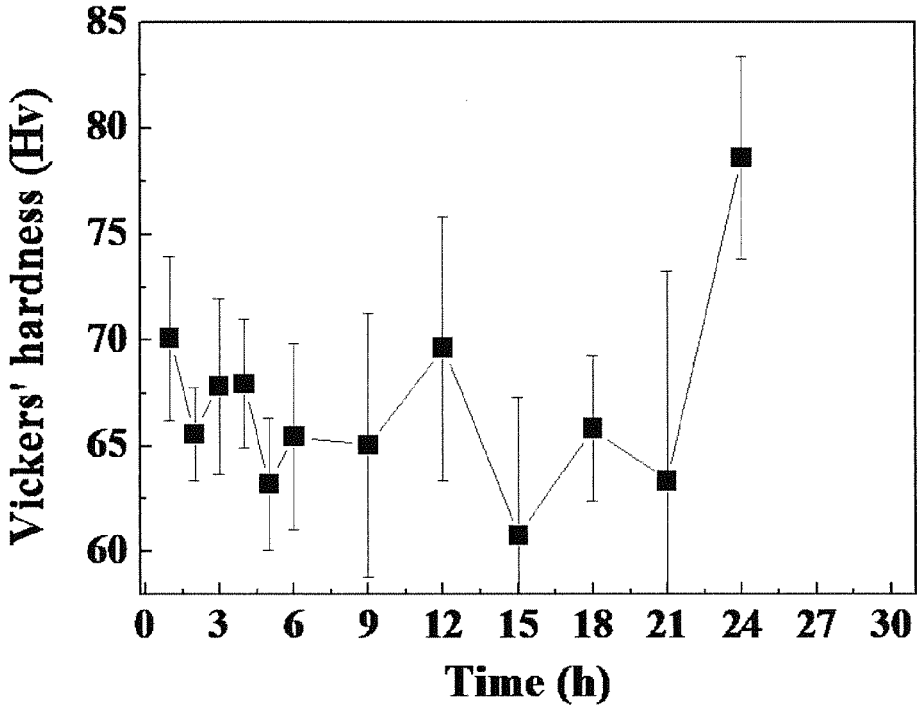
FIG. 18 is a view showing variation in the hardness of a Mg—$B_4C$ composite of the invention due to heat treatment time when heat-treated at 550° C.

Although C has been described as an example of an element that forces into a metal lattice and then deforms the metal lattice in the foregoing embodiment, it should be understood that the invention is not limited to C. C is one of elements that can form an intermetallic compound, and other elements, such as boron (B) or nitrogen (N) atoms, can also achieve the effects of the invention. FIG. 16 is a picture of the microstructure of a composite taken using a TEM, the composite including boron carbide ($B_4C$) dispersed in a Mg matrix. It can be appreciated that B clusters having a size ranging from 2 nm to 3 nm are dispersed due to the mechanical milling. This composite was heat-treated at 550° C., and a picture of the microstructure of the heat-treated composite taken using a TEM is shown in FIG. 17. As shown in FIG. 17, it can be appreciated that B atoms penetrated into the Mg lattice and deformed the Mg lattice, thereby forming Mg—B nano phases. FIG. 18 shows variation in hardness due to heat treatment of the Mg—B, which is formed as above. It can be appreciated that the hardness increases depending on the heat treatment time in the same manner as in the foregoing embodiment. It can be seen that the hardness is increased rather than decreased even though the composite was heat-treated at a relatively high temperature of 550° C. (about 0.9Tm, Tm: melting temperature of Mg). This also shows that the mechanical properties are improved due to the creation of the Mg—B nano phases. Like the foregoing embodiments, this is considered as originating from the influence of, for example, dislocations that are fixed around the nano phases. In addition, nano phase particles are also formed according to the same mechanism as the foregoing embodiments, thereby forming nano strips or a nano network structure. In the meantime, C in boron carbide also forms nano phases, such as Mg—C, like B. However, since the ratio of C to B is 1:4, the effects of Mg—C appear relatively insignificant when compared to Mg—B. However, like the Mg—B nano phases, Mg—C also appears contributing to the improvement of the mechanical properties to a certain degree. As such, this embodiment shows that an element, such as B or N, of a compound (e.g. boron carbide ($B_4C$) or boron nitride (BN)) that can penetrate into the metal lattice via enforced dissolution and deform the metal lattice can also be used in manufacturing a metal matrix composite, which has nano phases, nano strips or a nano network structure, according to the invention.

Although the invention has been described hereinabove with respect to the certain embodiments, it should be understood that the invention is not limited to the foregoing embodiments. It should be understood that, for example, the heat treatment temperature, time, and the like can vary depending on the type of a metal matrix that is used, the amount of a carbon material that is used, the amount of an intermetallic compound-forming element (N, B), and the like, and the heat-treating methods may also vary depending on applications. The invention can be variously modified and changed within the scope of the appended claims, and such modifications and changes fall within the scope of the invention. Therefore, it should be understood that the scope of the invention shall be defined only by the appended claims and the equivalents thereof.

The invention claimed is:

1. A method of manufacturing an aluminum matrix composite, the method comprising the steps of:

pulverizing a solid carbon material into a micrometer size, the solid carbon material being at least one selected from a group consisting of fullerene, carbon nano tube, graphite, carbon black and amorphous carbon;

plastically deforming aluminum matrix powders while dispersing the pulverized carbon material into the aluminum matrix powders so as to be dispersed in a nanometer size , thereby obtaining composite powders composed of aluminum/carbon nano material;

integrating the composite powders composed of aluminum/carbon nano material, thereby producing a bulk material; and heat-treating the bulk material, thereby forming a composite having therein at least one of aluminum-carbon nano phase particles that are formed by carbons released as a carbon-carbon bonding of the carbon material is broken and aluminum elements of the aluminum matrix, aluminum-carbon nano strips produced by growing-up of the aluminum-carbon nano phase particles, and an aluminum-carbon nano network structure produced by self-assembly of the nano strips, wherein in the aluminum matrix composite, dislocations are fixed around the aluminum-carbon nano phase particles, or grains of the aluminum matrix are micronized or growing-up thereof is inhibited due to the aluminum-carbon nano strips or the aluminum-carbon nano network structure, and wherein the aluminum matrix composite does not contain a carbon compound ($Al_4C_3$) caused by the carbons.

2. The method according to claim 1, wherein the heat treatment is performed in a temperature range that is sufficient for individual carbon atoms released as a carbon-carbon bonding of the carbon material is broken to diffuse to a short distance and penetrate into the lattice of the aluminum matrix, but not to form a carbon compound.

3. The method according to claim 2, wherein the heat treatment is performed at a temperature ranging from $0.5T_m$ to $1T_m$ ($T_m$: melting temperature of the metal matrix).

4. The method according to claim 1, wherein the composite contains at least one of aluminum-carbon nano phase particles, which are expressed by $Al_4C_x$ ($0<x<3$), aluminum-carbon nano strips produced by growing-up of the aluminum-carbon nano particles, and an aluminum-carbon network structure produced by self-assembly of the nano strips.

5. The method according to claim 4, wherein as time of the heat treatment increases, a mechanical strength of the aluminum matrix composite increases.

6. The method according to claim 1, wherein the carbon material is pulverized and dispersed using a mechanical milling process.

7. An aluminum matrix composite that is manufactured using aluminum matrix powders and at least one solid carbon material selected from a group consisting of fullerene, carbon nano tube, graphite, carbon black and amorphous carbon, wherein the aluminum matrix composite contains therein at least one of aluminum-carbon nano phase particles, which are formed as individual carbon atoms released when a carbon-carbon bonding of the carbon material is broken penetrate into lattices of the aluminum matrix through short-distance diffusion so that the lattices of the aluminum matrix are deformed or expanded, aluminum-carbon nano strips produced by growing-up of the aluminum-carbon nano phase particles, and an aluminum-carbon nano network structure produced by self-assembly of the nano strips, wherein dislocations are fixed around the aluminum-carbon nano phase particles, or grains of the aluminum matrix are micronized or growing-up thereof is inhibited due to the aluminum-carbon nano strips or the aluminum-carbon nano network structure, wherein the aluminum matrix composite does not contain a carbon compound ($Al_4C_3$) caused by the carbons, and wherein the composite contains therein at least one of aluminum-carbon nano phase particles, which are expressed by $Al_4C_x$ ($0<x<3$), aluminum-carbon nano strips produced by growing-up of the aluminum-carbon nano particles, and an aluminum-carbon network structure produced by self-assembly of the nano strips.

8. The aluminum matrix composite according to claim 7, wherein the aluminum matrix composite has a mechanical strength exceeding 500 MPa.

9. A method of manufacturing an aluminum matrix composite, the method comprising the steps of:

pulverizing fullerene, which is arranged in a face-centered cubic (fcc) structure in an early stage and is present in a form of powders having a micrometer size, via mechanical milling;

plastically deforming aluminum matrix powders via mechanical milling while dispersing the pulverized fullerene into the aluminum matrix powders so as to be dispersed in a nanometer size;

integrating composite powders composed of the aluminum matrix powders and the fullerene, thereby producing a bulk material; and heat-treating the bulk material, thereby forming a composite having therein at least one of aluminum-carbon nano phase particles that are formed by carbons released as a carbon-carbon bonding of the fullerene is broken and aluminum elements of the aluminum matrix, aluminum-carbon nano strips produced by growing-up of the aluminum-carbon nano phase particles, and an aluminum-carbon nano network structure produced by self-assembly of the nano strips, wherein in the aluminum matrix composite, dislocations are fixed around the aluminum-carbon nano phase particles, or grains of the aluminum matrix are micronized or growing-up thereof is inhibited due to the aluminum-carbon nano strips or the aluminum-carbon nano network structure, and wherein the aluminum matrix composite does not contain a carbon compound ($Al_4C_3$) caused by the carbons.

10. The method according to claim 9, wherein the heat treatment is performed in a temperature range that is sufficient for individual carbon atoms, which are released as a carbon-carbon bonding of the fullerene is broken, to diffuse to a short distance and penetrate into the lattices of the aluminum matrix, but not to form a carbon compound.

11. The method according to claim 10, wherein the heat treatment is performed at a temperature ranging from $0.5T_m$ to $1T_m$ ($T_m$: melting temperature of the aluminum matrix).

12. The method according to claim 9, wherein the composite contains therein at least one of aluminum-carbon nano phase particles, which are expressed by $Al_4C_x$ ($0<x<3$), aluminum-carbon nano strips produced by growing-up of the aluminum-carbon nano particles, and an aluminum-carbon network structure produced by self-assembly of the nano strips.

13. An aluminum matrix composite that is manufactured using aluminum powders and fullerene, wherein the aluminum matrix composite contains therein at least one of aluminum-carbon nano phase particles ($A1_4C_x(0<x<3)$), which are formed as individual carbon atoms released when a carbon-carbon bonding of the fullerene is broken penetrate into a lattice of the aluminum matrix through short-distance diffusion so that the lattice of the aluminum matrix is deformed or expanded, aluminum-carbon nano strips produced by growing-up of the aluminum-carbon nano phase particles, and an aluminum-carbon nano network structure produced by self-assembly of the aluminum-carbon nano strips, and wherein dislocations are fixed around the aluminum-carbon nano phase particles, or grains of the aluminum matrix are micronized or growing-up thereof is inhibited due to the aluminum-carbon nano strips or the aluminum-carbon nano network structure, and wherein the aluminum matrix composite does not contain a carbon compound ($A1_4C_3$) caused by the carbons.

14. The aluminum matrix composite according to claim 13, wherein the aluminum matrix composite has a mechanical strength exceeding 500MPa.

* * * * *